United States Patent [19]

Stettler

[11] 4,263,780

[45] Apr. 28, 1981

[54] LEAN PRECHAMBER OUTFLOW COMBUSTOR WITH SETS OF PRIMARY AIR ENTRANCES

[75] Inventor: Richard J. Stettler, Birmingham, Mich.

[73] Assignee: General Motors Corporation, Detroit, Mich.

[21] Appl. No.: 79,873

[22] Filed: Sep. 28, 1979

[51] Int. Cl.[3] ..... F02C 7/22

[52] U.S. Cl. ..... 60/39.23; 60/737; 60/748; 60/746; 60/743

[58] Field of Search ..... 60/39.23, 737, 743, 60/746, 748

[56] References Cited

U.S. PATENT DOCUMENTS

| | | | |
|---|---|---|---|
| 3,859,787 | 1/1975 | Anderson et al. | 60/737 |
| 3,930,368 | 1/1976 | Anderson et al. | 60/39.23 |
| 3,930,369 | 1/1976 | Verdouw | 60/39.23 |
| 4,141,213 | 2/1979 | Ross | 60/39.82 P |
| 4,155,220 | 5/1979 | Emory | 60/748 |

*Primary Examiner*—Robert E. Garrett
*Attorney, Agent, or Firm*—J. C. Evans

[57] ABSTRACT

A combustion apparatus for gas turbine engines particularly adapted to reduce emissions to meet automotive requirements. The fuel is laid on the wall of a cylindrical prechamber and evaporated from the wall by combustion air which is introduced through a swirler at the upstream end of the prechamber. The inner surface of the prechamber is artificially roughened by a grid of grooves to improve fuel evaporation. The fuel is laid on the wall from an annular manifold extending around the upstream end of the prechamber through tangential orifices leading from the manifold into the interior of the prechamber. More air enters through entrance ports distributed around the prechamber toward its downstream end. The resulting lean fuel-air mixture is delivered past an annular flow dam at the outlet of the prechamber into a domed combustor wall forming a combustion or reaction zone which is abruptly enlarged from the prechamber. Still other air bypasses the prechamber and is directed through ports formed in the dome of the combustor wall where swirlers direct the bypassed air into prevaporized fuel and air from the prechamber. The structure reduces pressure drop across the flow dam while enhancing turbulent flow, recirculation, and good mixing in the reaction zone. A dilution zone downstream of the reaction has a circumferential array of dilution air ports which are of such shape as to be varied nonlinearly in area by a sliding ring valve. The sliding ring valve is coupled to a second sliding ring valve which varies the area of the air entrance ports in the prechamber in reverse sense to the dilution air ports.

4 Claims, 4 Drawing Figures

LEAN PRECHAMBER OUTFLOW COMBUSTOR WITH SETS OF PRIMARY AIR ENTRANCES

This invention relates to combustion chambers of a type suitable for use with gas turbine engines. It is particularly directed to combustion chamber structures adapted to insure complete combustion over relatively wide ranges of air and fuel flow and to minimize discharge of incompletely burned fuel and generation of oxides of nitrogen.

One satisfactory low emissions burner is set forth in U.S. Pat. No. 3,859,787, issued Jan. 14, 1975, to Anderson et al, for Combustion Apparatus, which includes variable geometry or variable flow control by which the distribution of combustion air to the reaction and dilution zones of the combustion chamber may be varied so as to provide clean burning under widely varying conditions of air and fuel flow. In order to prevent flashback into a prevaporization prechamber the combustion apparatus includes an annular flow dam which can desirably restrict primary air flow to the reaction chamber when additional air is required to the reaction zone for cooler combustion.

If air flows are reduced to compensate for flow restriction, the reaction zone temperature can undesirably increase. As required, fuel is directed therein and air flow is restricted because of flow dam diameter restriction.

Accordingly, an object of the present invention is to improve low emission combustor chamber apparatus including a prechamber operative to ensure complete combustion of an air-fuel mixture over relatively wide ranges of air and fuel flow while minimizing the discharge of incompletely burned fuel and generation of oxides of nitrogen from the combustor by the provision of a multistage injection of air and fuel swirl patterns including at least one air and fuel swirl pattern that is directed into the reaction zone of the combusion apparatus without passing across an annular flashback flow dam between a prechamber and an abruptly enlarged reaction chamber thereby to reduce pressure loss as more air is directed into the primary zone to meet increased engine power requirements and wherein the swirled air which is bypassed directly into the primary zone reduces the combustion temperatures therein so as to reduce the formation of oxides of nitrogen during engine operation.

Still another object of the present invention is to improve prevaporization type low emission combustion apparatus for use in automotive gas turbine engine powered vehicles wherein the size of a prevaporization prechamber restricts flow that would cool combustor temperature and wherein an improved air swirl and fuel supply system is associated with the prechamber to direct combustion air partially through the prechamber and partially into a first swirl pattern within the upstream end of an abruptly enlarged reaction zone downstream of the prechamber whereby part of the primary air bypasses the prechamber to reduce pressure loss thereacross during operation of the engine at greater power and wherein the directly bypassed air flowing into the first swirl pattern of the reaction zone limits the combustion temperature within the reaction zone to increase the range of operation of the engine without excessive formation of oxides of nitrogen.

Yet another object of the present invention is to provide an improved air cooled combustion apparatus for use in a lightweight gas turbine engine for automotive vehicle use wherein a prevaporization chamber is operative to direct a plurality of air-fuel swirl patterns across an annular flashback dam into an abruptly enlarged reaction zone and wherein a prechamber swirler has a plurality of sheet metal members with first end portions connected to an upstream located manifold fuel distributor with an inner roughened surface and with second opposite ends thereon connected to the dome portion of a combustor wall forming the large reaction chamber and wherein the thermal mass of the sheet metal members of the swirler is quickly cooled by air flow thereacross so as to maintain the temperature of the swirler below that which would otherwise tend to ignite unburned hydrocarbons in the prechamber thereby to prevent flame formations in the prechamber so as to reduce emissions of oxides of nitrogen from the combustion apparatus.

Another object is to provide a combustor for automotive turbine engine applicatons of the type having a prevaporization chamber, an abruptly increased volume main reaction chamber downstream of said prevaporization chamber with an annular flow dam formed between the outlet of the prechamber and the reaction chamber to define an orifice therebetween to prevent flame entry from the main reaction chamber into the prechamber, and wherein a main fuel manifold is located at the inlet end of said prevaporization chamber for distributing combustor fuel as a film across said roughened surface to produce vaporization of the fuel film and improved by three distinct air swirlers including one at the inlet end of the prechamber producing a first swirl pattern within the prevaporization chamber for mixing evaporated fuel from the film with a first quantity of primary combustion air; a second swirler having a ring of swirl ports formed in the prevaporization chamber to direct a second quantity of primary combustion air into the prevaporization chamber as more fuel is added to the combustor and to produce a second swirl pattern therein for further mixing of evaporated fuel and the second quantity of primary air; and a third swirler including a plurality of bypass ports for directing a third quantity of primary air directly into the reaction chamber in bypassed relationship to the air flow through the swirler ports and including means located within the reaction chamber for swirling the third quantity of primary air within the main reaction chamber immediately downstream of the flow dam to produce further mixing of the first and second quantities of air and fuel mix therewith within the main reaction chamber to lower combustion temperatures to reduce oxides of nitrogen and to maintain combustion efficiency during all phases of gas turbine engine operation, air flow control being provided by variable geometry valve means operatively associated with said swirl ports and said plurality of bypass ports to concurrently regulate air flow therethrough to produce a flow of bypassed primary combustion air directly into the reaction chamber downsteam of the outlet of said prevaporization tube, thereby to reduce the total volume of air flow through the orifice to prevent excessive pressure drop thereacross during engine operation.

Further objects and advantages of the present invention will be apparent from the following description, reference being had to the accompanying drawings wherein a preferred embodiment of the present invention is clearly shown.

Figure 3:
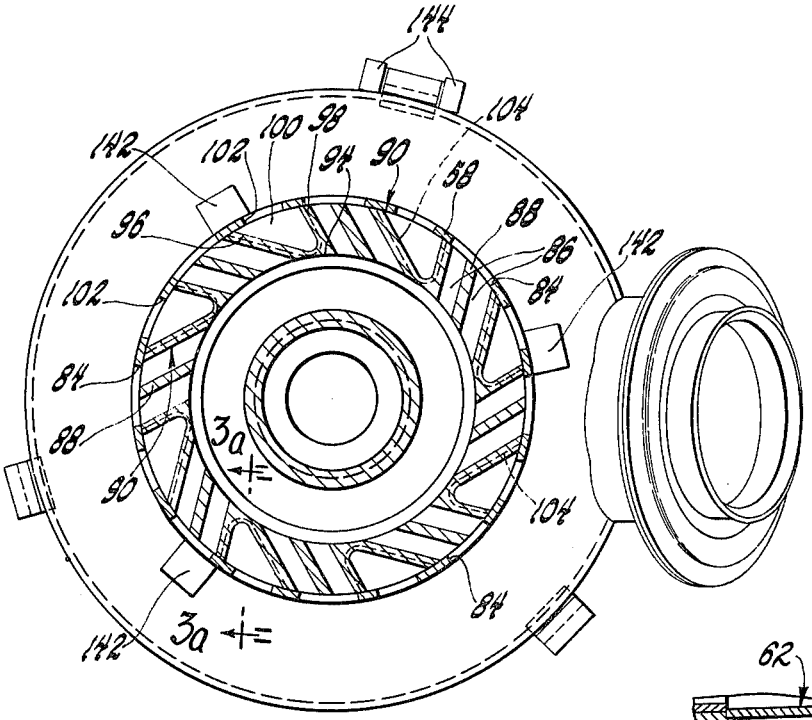
FIG. 3 is a cross-sectional view of the prechamber taken on the plane indicated by the line 3—3 in FIG. 1.
Figure 3A:
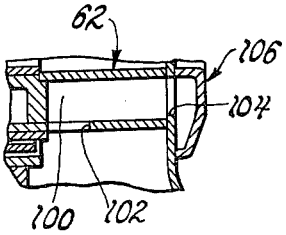

FIG. 3*a* is a fragmentary sectional view taken along line 3*a*—3*a* of FIG. 3.

Figure 1:
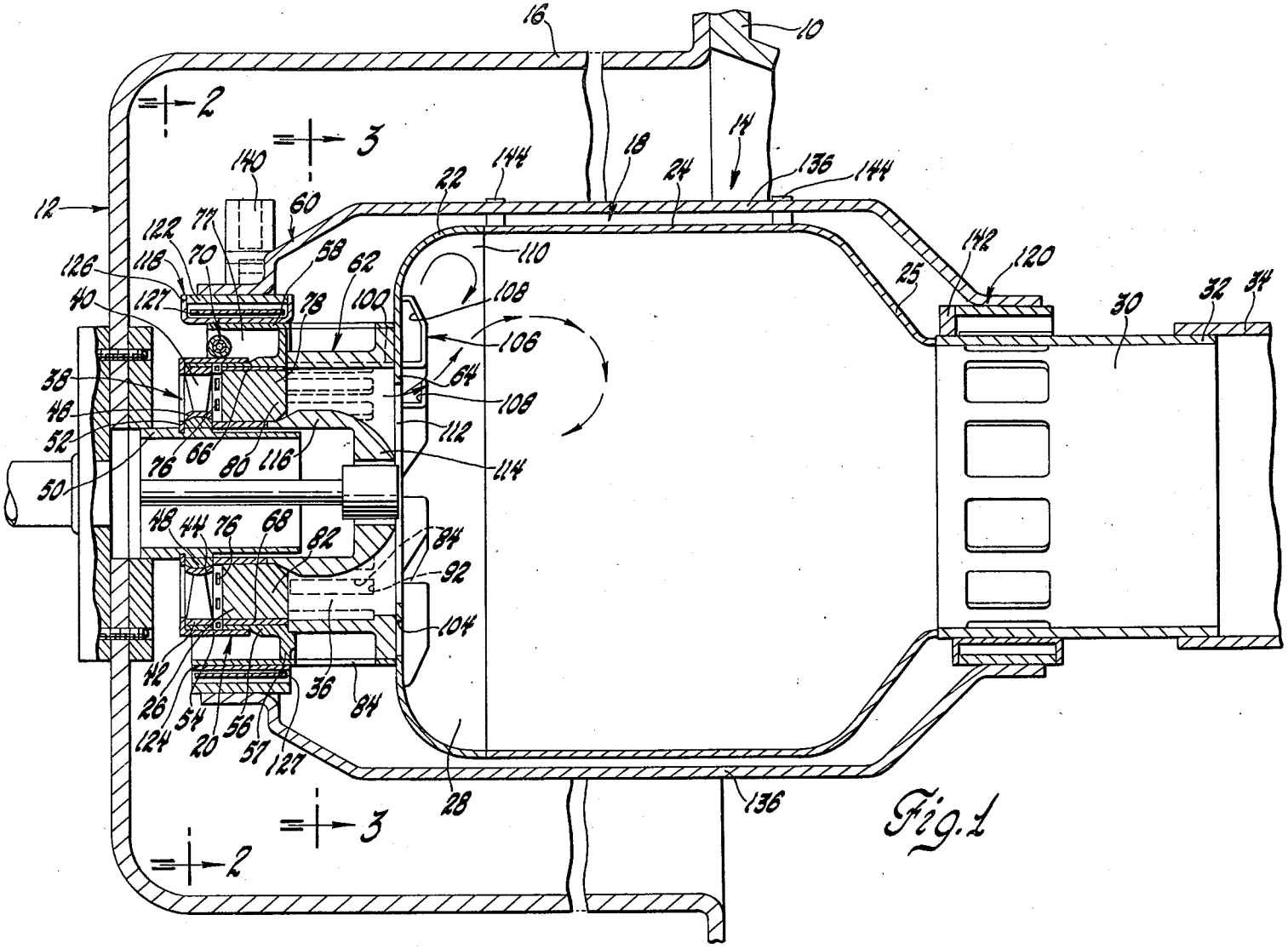
FIG. 1 is a longitudinal sectional view of the combustion apparatus of the present invention.

Referring to FIG. 1, a gas turbine engine case 10 is shown. Further details of the engine are not shown or described, since they are immaterial to an understanding of the present invention. By way of background, however, the engine may be a regenerative gas turbine of the general nature of those described in U.S. Pat. Nos. to Collman et al, 3,077,074, issued Feb. 12, 1963; and 3,267,674, issued Aug. 23, 1966; and U.S. Pat. No. 3,490,746, issued Jan. 20, 1970, to Bell.

The engine case 10 forms part of an outer casing 12 around the combustion apparatus 14 of the present invention. Casing 12 also includes a cylindrical housing 16 bolted to the engine case. In an engine of this sort, the engine compressor (not illustrated) delivers compressed air which is heated in a regenerator (not illustrated) on its way into the combustion apparatus casing 12.

Figure 2:
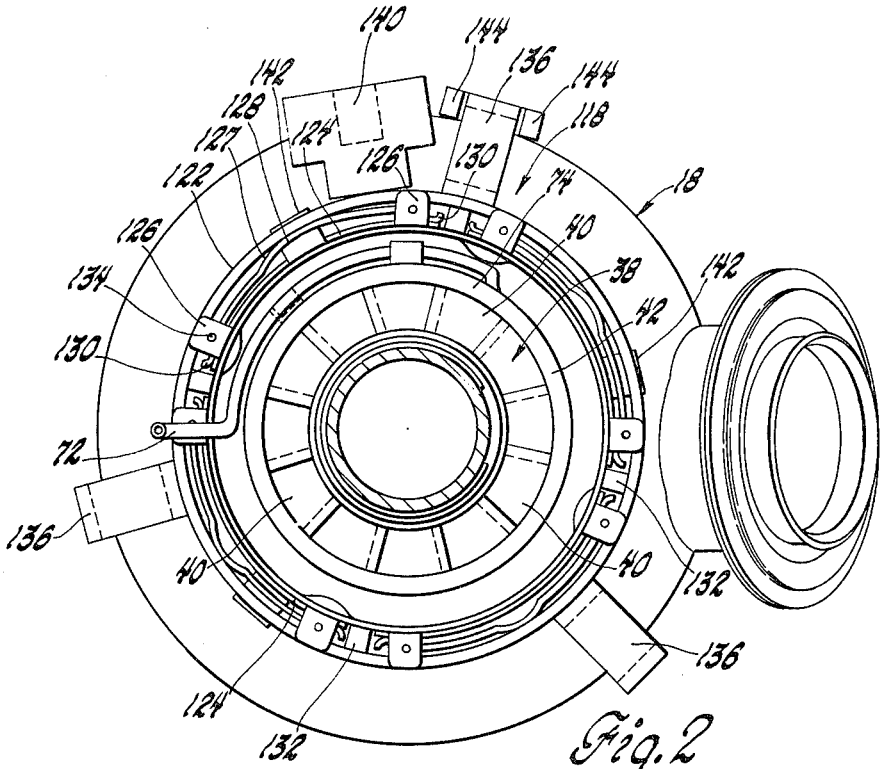
FIG. 2 is an upstream end view of the combustion apparatus taken on the plane indicated by the line 2—2 in FIG. 1.

Referring to FIG. 2, the combustion apparatus 14 has a combustion liner 18 and in its preferred form is of circular cross-section. The liner wall 18 includes a first prechamber or fuel vaporizing wall portion 20 which extends to an abrupt radial enlargement defined by a substantially radially outwardly extending wall portion 22 which is integral with and continues into a cylindrical wall portion 24. The wall portion 20 encloses an annular fuel vaporizing zone 26 of the combustion apparatus and the wall portion 24 encloses a primary reaction zone 28 and a dilution zone 30. Wall 24 terminates in an outlet 32 for combustion products at the downstream end of the combustion liner. As shown in FIG. 1, the outlet end may be inserted into a combustion products duct 34 leading to the turbine (not shown). This supports the downstream end of the liner.

In operation of the combustion apparatus, fuel is evaporated and the fuel and air are mixed in a prechamber 36 enclosed by wall portion 20. The fuel and air react, or combustion takes place, in the reaction zone 28 and additional air is introduced and mixed with combustion products in the dilution zone 30 to provide the ultimate mixture of combustion products to drive the turbine of the gas turbine engine.

Considering now in more detail the structure of the combustion liner, beginning with the upstream end, part of the combustion air enters the upstream end through a swirler 38 comprising an annular cascade of vanes 40, as best shown in FIG. 2. These vanes extend from an outer ring 42 to a swiveled inner ring 44, the latter being supported by a spherical surface 46 on a bearing ring 48 slidably supported on the outboard end of a center body sleeve 50 and held thereon by a lock ring 52. The vanes of the swirler are set at an angle of 75° to a plane extending axially of the combustion apparatus so as to impart a strong swirl component to air entering the liner at this point from the outer casing 12. The outer ring 42 is welded or brazed to a manifold sleeve 54 piloted on and fixed to the forward end of a rear prechamber wall portion 56. A downstream flanged end 57 of wall portion 56 is welded to a radially located valve assembly sleeve 58 of a variable geometry air flow controller 62 that controls air flow through a swirler assembly 60 constructed in accordance with the present invention to prevent entry of reaction zone flame into zone 26. The assembly is connected at a sheet metal flow dam 64 extending over the outlet of the prechamber.

The hot compressed air forced through swirler 38 will flow with a strong tangential component over the inner roughened surface 66 of a liner 68 in sleeve 56 and because of centrifugal force will tend to scour these walls. In so doing, it vaporizes and picks up liquid hydrocarbon fuel which is fed to the inner surface of the prechamber just downstream of swirler 38 as a fuel film. The fuel film is introduced from a manifold assembly 70 and includes a fuel inlet tube 72 with an outlet feeding a ring 74 extending entirely around the outer surface of liner 68 at its upstream edge. Fuel is delivered from this manifold through orifice slits 76 which receive fuel from an external source of supply (not illustrated). Manifold assembly 70 is thereby located within a shielded space 77 formed by sleeve 58 and flange 56 and is thereby, to some extent, maintained cooled and insulated from heat which may be radiated from hot engine components near the flame tube.

Fuel supplied to the manifold assembly 70 is laid on the interior of the liner through the orifice slits 76 from which the fuel is squirted onto the inner surface of the liner 68 rather than into the air flowing through the swirler. The fuel is supplied at low pressure, the peferred maximum pressure drop through slits 76 being about 20 psi. The current of air flowing through the swirler 38 blows the introduced fuel along the inner surface of the prechamber liner 68 and the hot rapidly moving air heats and vaporizes and mixes with the fuel before entry through the swirler 62 and thence into reaction zone 28.

A substantial improvement in the vaporization and mixing of fuel with the air has been found to result from providing a roughened or textured surface on the interior of the prechamber wall. Preferably, this textured surface extends from just downstream of the fuel entrance slits 76 to the swirler 62 at the upstream end thereof. This textured surface may be similar to a knurled surface. The surface is relieved to provide a grid of two intersecting sets of small grooves 78, 80 which leave between them small substantially rectangular bosses 82. This sort of textured surface may most readily be achieved by coating the areas which provide the bosses 82 with a suitable resist and then etching the surface to the desired depth. The resist may be applied by a photographic process, as is well understood. In the presently preferred form of the structure, the center-to-center spacing of adjacent grooves of each set is approximately 0.05 inch and the grooves are about 0.003 deep. The width of each groove is about the same as the width of the bosses between the grooves. Orientation of the grooves is preferably at about a 45° angle to the axial direction through the prechamber so that the fuel introduced into the inner wall may flow downstream of the prechamber under the influence of the air stream through the channels defined by the helically extending grooves 78, 80.

It is believed that the superior performance with the textured surface is due to turbulence in the air flow on a small scale, aided by the bosses 82 which improve heat transfer from the air, and also to the partial shielding of the liquid fuel within the grooves 78, 80 from the direct blast of the air. At any rate, it has been demonstrated that this textured surface aids in the complete vaporization and diffusion of the fuel in the air.

It has been found that burning of a lean mixture in the reaction zone 28 is preferable from the standpoint of clean exhaust to burning of a nearer to stoichiometric mixture. It is found desirable to introduce some air beyond that introduced by the swirler 38 to further mix with and dilute the fuel-air mixture prior to the initiation of combustion. This is effected by a first set of air entrances 84 distributed around the improved swirler 60 at the sleeve 58 thereof, preferably extending from the downstream end of liner 68 to a point immediately upstream of dam 64.

The presently preferred structure for introduction of additional air introduces the air with radially inward and tangential components of movement and no significant axial component. It also provides for variation of the effective area and therefore flow capacity of the prechamber downstream air inlet which is desirable as a part of means for maintaining the desired equivalence ratio in the reaction zone. Equivalence ratio will be understood to mean the ratio of the actual weight ratio of fuel to air to the stoichiometric ratio of fuel to air. This is accomplished effectively by varying the ratio between the quantity of air flowing into the reaction zone from the prechamber to that introduced through dilution ports in the dilution zone 30 as the ratio of total air flow to fuel flow varies.

Considering first the air entrance means through the sleeve 58 as illustrated in FIGS. 1 and 3, swirler 60 includes an annular array of slots 84 formed in the sleeve 58. It will be seen from FIG. 3 that flow through slots 84 enters the chamber through passages 86 between sheet metal director vanes 88 and bypass channels 90 at a considerable angle to the radial, and is so oriented that the direction of swirl of air from these slots is the same as that imparted by the inlet swirler 38. The outline of the slots is rectangular, the walls which bound the slots being parallel from each other in the direction toward the upstream end of the prechamber from a semicircular end segment 92. The director vanes 88 connect at their opposite ends to flange 57 and wall portion 22 and have sufficient solidarity to prevent direct through flow from slots 84 on one side of sleeve 58 to the opposite side thereof.

The bypass channels 90 are bent so as to have a radially inwardly located segment 94 thereon and to have angularly offset walls 96, 98, each of which bounds an axially directed bypass passage 100 that is communicated with inlet plenum air through a slot 102 formed in the sleeve 58 at circumferentially spaced points with respect to the slots 84 therein.

In the illustrated arrangement, each of the axial bypass passages 100 is in communication with an end port 104 that is directed through the wall 22 as is shown at the lower half of the wall 22 in FIG. 3*a*. The end ports 104 each have a sheet metal baffle 106 located in overlying relationship therewith with a side opening 108 therein so that axially directed air that strikes the baffle 106 is passed in a tangentially side direction through the opening 108 to produce a swirl pattern 110 independent of the swirl pattern produced by the swirler 38 at the inlet end of the prechamber 20 and by the swirler 60 during operation of the combustor for reasons to be discussed.

Each of the opposite ends of the bypass channels 90 is connected to the flange 57 and the wall 22, respectively. As a result, the swirler 60 is made up of a lightweight sheet metal construction that is relatively open to air flow in surrounding relation therewith so that it is cooled during operation of the combustor with a flame front is present within the reaction zone 28. The advantage of this arrangement is that in cases where there is a tendency for flashback of flame from the reaction zone 28 to enter an annular flow space 112 between the annular dam 64 and a conoidally configured tip 114 on a center body 116 within the swirler 60, the metal of the swirler 60 will be sufficiently cooled to prevent hot spots from igniting the air-fuel mixture therein which flows from the manifold assembly 70. In other words, any transient tendency for flashback into the prevaporization portion of the combustor will not be self-sustained by ignition by the component parts of the swirler 60.

Yet a more important aspect of the present invention, however, is due to the provision of the axial bypass passages 100 within the swirler 62 and the manner in which the air flow is controlled therethrough during combustor operation.

In combustion apparatus of the illustrated type, it has been noted that an annular flow path such as that defined between the conoidally configured center body tip 114 and the flow dam 64 is reduced in area and will restrict air flow required for high speed lightweight automotive gas turbine engine use. Eventually, the reduction reaches a point where the required amount of primary air flow into the primary zone 28 can produce undesirable pressure drop during air flow and mixing of fuel within the prechamber so as to affect the combustion temperature in an undesirable fashion. In accordance with certain principles of the present invention, even though the size of the prechamber is limited by virtue of the sizing of the component parts of the combustion apparatus, the size of the prechamber is no longer a limit insofar as the amount of air required to be sent through the prechamber into the reaction zone to maintain desired air-fuel combustion and combustion zone temperatures therein. Since some of the air is directed to the axial bypass passages 100, excessive pressure drop will not occur through the annular flow path 112. Enough air is directed through bypass passages 100 into the reaction zone 28 to prevent excessive temperatures therein that might otherwise cause a formation of oxides of nitrogen.

Accordingly, in practicing the invention, a fixed amount of primary air is admitted through the prechamber through the swirler 38 and the swirling air therefrom assists in the vaporization of fuel from the manifold assembly 70. This initial premix of air and fuel establishes a homogeneous mixture at the exit of the liner 68 and the roughened surface thereon. This homogeneous mixture is further premixed with primary air through the swirler 62 at the slots 84 therein. The amount of air flow through the slots 84 and through the passages 86 formed between the director vanes 88 is selected to prevent excessive pressure drop at the annular flow path 112 and provides further mixing required for prevaporization of fuel flow into the reaction zone 28. The variable geometry air flow controller will proportion the amount of air flow through the swirler 60 so that not all of it will have to pass through the annular flow path 112 and a certain preselected quantity of it will flow through the axial bypass passages 100, thence through the end ports 104 to be acted upon by the baffles 106. The amount of air flow through the passages 86 into the prechamber 20 is that which is required to mix with additional fuel passed through the main fuel assembly 70 into the prechamber during engine operations at increased power levels. The reduced diameter orifice defined by the annular dam 64 is selected to eliminate flashback into the prechamber. Such flashback prevention, of course, is well known in the art and is required to prevent a flame front from pre-igniting the air-fuel mixture and producing excessive oxides of nitrogen. As more fuel is directed through the manifold to obtain more engine power, primary air can be added to the reaction zone, by virtue of the improved arrangement by causing the variable geometry air flow controller to produce more opening up of the slots 102 leading to the axial bypass passages 100. The air added from the baffles outlets 108 and the swirl pattern 110 produced thereby mixes with the swirling mixtures from the prechamber which passes through the annular flow path opening 112 and since both of the patterns are preferably at different velocities, they can cause a shear of the swirling gases and an immediate mixing prior to combustion within the reaction zone 28. This added primary air eliminates excessive pressure drop in prechamber designs and yet reduces the temperature of the combustion within the primary zone so that even better reduction of oxides of nitrogen can be produced.

In accordance with the present invention, air flow in both the primary reaction zone 28 and the dilution zone 30 is under the control of two movable slide valves 118, 120. The slide valve means 118, as best shown in FIGS. 1 and 2, has a rigid external actuating ring or hoop 122 which is spaced from the exterior of the wall portion 22, as best shown in FIG. 1. The controller 60 further includes four valve plates 124.

The two movable slide valve means 118 and 120 are of essentially the same type of structure. Considering first the valve means 118 shown in FIGS. 1 and 2, it comprises a rigid external actuating ring or hoop 122, preferably about 2 to 2½ millimeters in thickness, which is spaced from the exterior of sleeve 58. The valve assembly also includes four valve plates 124 each extending nearly 90° around the circumference. These plates are of approximately quarter-cylindrical shape so as to fit the outer surface on sleeve 58. Each plate 124 bears four tabs 126, one at each corner of the plate, which extend past the forward and rear edges of the ring 122 as shown clearly in the figures. These tabs have a slight clearance from the edges of ring 122 so that the plates 124 must move axially with the actuating ring 122 but can move radially relative to the ring 122.

The valve plates 124 are held resiliently in contact with the liner wall so as to permit relative expansion and minimize undesired friction while maintaining close contact. This is accomplished by a leaf spring 127 for each valve plate, each leaf spring having a slight bend or break at its center at 128 where it bears against the inside of the actuating ring 122. Each spring also has two slightly rolled end portions 130 which bear against the valve plate near its circumferential ends. The tabs 126 also confine the leaf spring 127 against slipping axially out of place.

The valve plates and leaf springs are held in position circumferentially of the ring 122 by four small blocks 132 fixed to and extending inwardly from the ring to proximity to the exterior of the liner wall. It will be seen, therefore, that the ring 122 is rather loosely guided on the liner wall but that it provides a reaction point for the springs 127 which hold the valve plates 124 which control air flow in contact with the liner wall. The tabs 126 have holes 134 through them through which a wire or the like may be inserted to hold the valve parts together until they are in place on the liner wall.

The slide valve means or assembly 120 illustrated particularly in FIG. 1 is essentially of the same construction as the assembly 118 except for dimensions and except for the adaptation to the deformation of the liner wall at 25.

Proceeding now to the arrangement for jointly reciprocating the valve means 118 and 120, there are coupled together by three struts 136 equally spaced around the liner which are welded to both actuating rings. A threaded boss 140 at the front end provides for connection to an external actuator (not illustrated) by which the valves are moved.

The forward movement is limited by three stop blocks 142 spaced around and fixed to the exterior of the section 20 of the liner. Two guide blocks 144 disposed on opposite sides of the upper strut 136, as illustrated in FIG. 2, serve to locate the struts circumferentially of the liner.

While the embodiments of the present invention, as herein disclosed, constitute a preferred form, it is to be understood that other forms might be adopted.

The embodiments of the invention in which an exclusive property or privilege is claimed are defined as follows:

1. A low emissions prevaporization type combustor assembly for use in automotive turbine engine applications comprising: a fuel vaporizing prechamber having an inlet, an outlet and a roughened inner surface, an outer combustor wall downstream of the outlet of said prechamber and having a greater diameter than said prechamber to define a main reaction zone downstream of said prechamber, means including an annular flow dam formed between the outlet of said prechamber and said reaction zone to define a flash prevention orifice therebetween to prevent a flame front from within the main reaction zone from entering said prechamber, a main fuel manifold located at the inlet of said prechamber for distributing combustor fuel as a film across said roughened surface to produce vaporization of the fuel film, a primary air swirler at the inlet of said prechamber for producing a first swirl pattern within said prechamber for mixing evaporated fuel from the film with a first quantity of primary combustion air, a swirler having a ring of swirl ports formed downstream of said prechamber to direct a second quantity of primary combustion air into the combustor as more fuel is added to the combustor and to produce a second swirl pattern for further mixing of evaporated fuel and the second quantity of primary combustion air, and means defining a plurality of bypass ports for directing a third quantity of primary air directly into the reaction zone in bypassed relationship to the air flow through said swirl ports, and variable geometry valve means operatively associated with said swirl ports and said plurality of bypass ports to concurrently regulate air flow therethrough to produce a bypass flow of primary combustion air directly into the reaction zone downstream of said flow dam thereby to reduce the total volume of air flow through the orifice to prevent excessive pressure drop thereacross during engine operation from idle operation to full power operation, and means located within the reaction zone for swirling the third quantity of primary air within the main reaction zone to produce further mixing of the first and second quantities of air and fuel mix therewith within the main reaction zone to lower combustion temperatures to reduce oxides of nitrogen and to maintain combustion efficiency during all phases of gas turbine engine operation.

2. A low emissions prevaporization type combustor assembly for use in automotive turbine engine applications comprising: a fuel vaporizing prechamber having an inlet, an outlet and a roughened inner surface, an outer combustor wall downstream of the outlet of said prechamber and having a greater diameter than said prechamber to define a main reaction zone downstream of said prechamber, means including an annular flow dam formed between the outlet of said prechamber and said reaction zone to define a flash prevention orifice therebetween to prevent a flame front from within the main reaction zone from entering said prechamber, a main fuel manifold located at the inlet of said prechamber for distributing combustor fuel as a film across said roughened surface to produce vaporization of the fuel film, a primary air swirler at the inlet of said prechamber for producing a first swirl pattern within said prechamber for mixing evaporated fuel from the film with a first quantity of primary combustion air, a swirler having a ring of swirl ports formed downstream of said prechamber to direct a second quantity of primary combustion air into the combustor as more fuel is added to the combustor and to produce a second swirl pattern for further mixing of evaporated fuel and the second quantity of primary combustion air, said swirler being comprised of quickly cooled sheet metal directors and sheet metal double walled channels with a metal mass which is cooled by the second quantity of primary combustion air to prevent transitory backflash from heating the swirler to a metal temperature which will produce ignition of air-fuel mixtures in the prechamber, and means including said channels defining a plurality of bypass ports for directing a third quantity of primary air directly into the reaction zone in bypassed relationship to the air flow through said swirl ports, and variable geometry valve means operatively associated with said swirl ports and said plurality of bypass ports to concurrently regulate air flow therethrough to produce a bypass flow of primary combustion air directly into the reaction zone downstream of said flow dam thereby to reduce the total volume of air flow through the orifice to prevent excessive pressure drop thereacross during engine operation from idle operation to full power operation, and means located within the reaction zone for swirling the third quantity of primary air within the main reaction zone to produce further mixing of the first and second quantities of air and fuel mix therewith within the main reaction zone to lower combustion temperatures to reduce oxides of nitrogen and to maintain combustion efficiency during all phases of gas turbine engine operation.

3. A low emissions prevaporization type combustor assembly for use in automotive turbine engine applications comprising: a prevaporization tube having opposite open ends with a roughened surface therein, an outer combustor wall downstream of the outlet end of said tube and having a greater diameter than said tube to define a main reaction zone, means including an annular flow dam formed between the outlet of said tube and said reaction zone to define a flash prevention orifice therebetween to prevent a flame front from within the main reaction zone from entering the prevaporization tube, a main fuel manifold located at the inlet end of said prevaporization tube for distributing combustor fuel as a film across said roughened surface to produce vaporization of the fuel film, a primary air swirler at the inlet open end of said tube for producing a first swirl pattern within said prevaporization tube for mixing evaporated fuel from the film with a first quantity of primary combustion air, a swirler having a ring of swirl ports downstream of said prevaporization tube to direct a second quantity of primary combustion air into said reaction zone as more fuel is added to the combustor and to produce a second swirl pattern for further mixing of evaporated fuel and the second quantity of primary combustion air, and means defining a plurality of bypass ports for directing a third quantity of primary air directly into the reaction zone in bypassed relationship to the air flow through the swirl ports, and variable geometry valve means operatively associated with said swirl ports and said plurality of bypass ports to concurrently regulate air flow therethrough to produce a flow of bypass primary combustion air directly into the reaction zone downstream of said flow dam thereby to reduce the total volume of air flow through the orifice to prevent excessive pressure drop thereacross during engine operation from idle operation to full power operation, and means located within the reaction zone for swirling the third quantity of primary air within the main reaction zone to produce further mixing of the first and second quantities of air and fuel mix therewith within the main reaction zone to lower combustion temperatures to reduce oxides of nitrogen and to maintain combustion efficiency during all phases of gas turbine engine operation.

4. A low emissions prevaporization type combustor assembly for use in automotive gas turbine engine applications comprising an upstream wall forming a prevaporization chamber having opposite ends and a roughened inner surface, an outer combustor wall downstream of the outlet end of said prevaporization chamber and having a greater diameter than said upstream wall to define a main reaction chamber, a downstream duct connected to an outlet from said reaction chamber, an annular dam located between the outlet end of said prevaporization chamber and said reaction chamber to define a flash preventor orifice therebetween to prevent a flame front from within the main reaction chamber from entering the prevaporization chamber, a main fuel manifold located at the inlet end of said prevaporization tube for distributing combustor fuel as a film across said roughened inner surface to produce evaporization of the fuel film, a primary air swirler at the inlet open end of said chamber for producing a first swirl pattern within said prevaporization tube for mixing evaporated fuel from the film with a first quantity of primary combustion air, a fixed support member, and means including coacting spherical surfaces interposed between said fixed support member and said primary air swirler to adjustably and angularly position said combustor with respect to said fixed support member to accommodate thermal differences between said downstream duct and said fixed support member.

* * * * *